United States Patent [19]

Ponsart

[11] Patent Number: 4,938,487

[45] Date of Patent: Jul. 3, 1990

[54] BOWLING AID

[76] Inventor: Eugene E. Ponsart, 705 Sandia Dr., Port St. Lucie, Fla. 34983

[21] Appl. No.: 326,613

[22] Filed: Mar. 21, 1989

[51] Int. Cl.[5] ..... A63B 71/14; A63B 69/00

[52] U.S. Cl. ..... 273/54 B; 273/64; 434/249; 2/160; 2/161 A; 2/163; 623/64

[58] Field of Search ..... 273/54, 64; 434/249; 2/20, 160, 161 R, 161 A, 163; 623/64

[56] References Cited

U.S. PATENT DOCUMENTS

| | | | |
|---|---|---|---|
| 852,972 | 5/1907 | Mackay . | |
| 1,498,029 | 6/1924 | Giles . | |
| 1,893,714 | 1/1933 | Owen | 623/57 |
| 2,482,395 | 9/1949 | Zander . | |
| 3,046,014 | 7/1962 | Abruzzi . | |
| 3,098,654 | 7/1963 | Larsen . | |
| 3,208,749 | 9/1965 | Skuse . | |
| 3,214,167 | 10/1965 | Pell . | |
| 3,790,168 | 2/1974 | Hashimoto | 2/161 A |
| 3,871,029 | 3/1975 | Hollman . | |
| 4,441,711 | 4/1984 | Dubar et al. | 2/161 A |
| 4,519,097 | 5/1985 | Chappell, Jr. et al. . | |
| 4,531,241 | 7/1985 | Berger . | |
| 4,575,075 | 3/1986 | Tarbox et al. . | |

*Primary Examiner*—Edward M. Coven
*Assistant Examiner*—William M. Pierce
*Attorney, Agent, or Firm*—Albert W. Hilburger

[57] ABSTRACT

A bowling aid to enable a person to bowl whose natural thumb is missing, deformed, or injured, or to provide a person having a healthy thumb with an alternative mode of ball handling and control. A semi-rigid support member is removably received on the hand of the bowler and, when so received, extends between the upper surface of the hand and the palm of the hand and is contoured to snugly conform to the hand. An artificial thumb member is provided on the support member proximate to the general location of a natural thumb and projects away from the support member and away from the palm of the bowler's hand and is so sized and positioned as to be receivable in the thumb hole of a bowling ball when fingers of the bowler are received in the finger holes of the bowling ball. The bowling aid may be size adjustable and can be releasably secured to the hand. The support member may have an outer covering of flexible material such as fabric, leather, or plastic nonwoven sheet material.

13 Claims, 3 Drawing Sheets

FIG. 4.
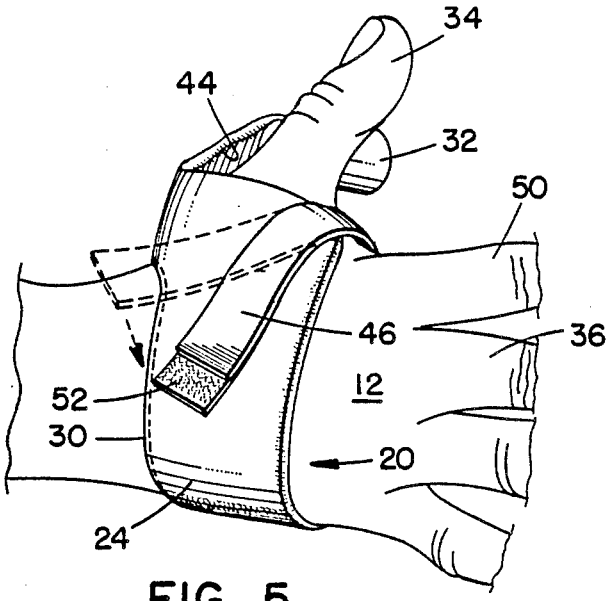
FIG. 7.
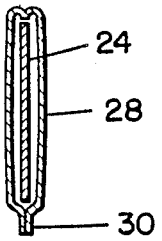
FIG. 5.
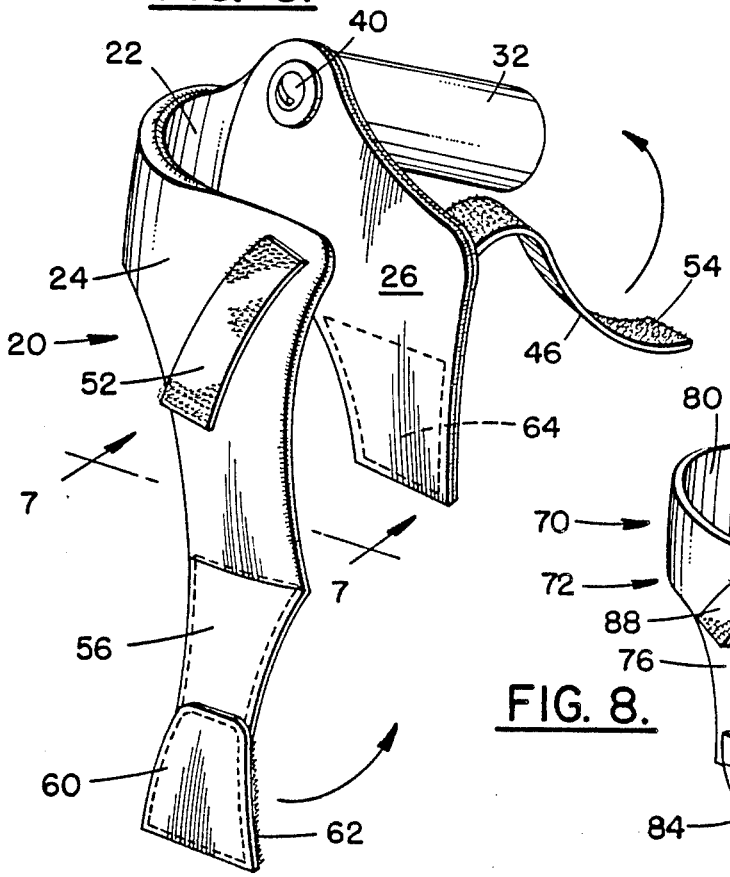
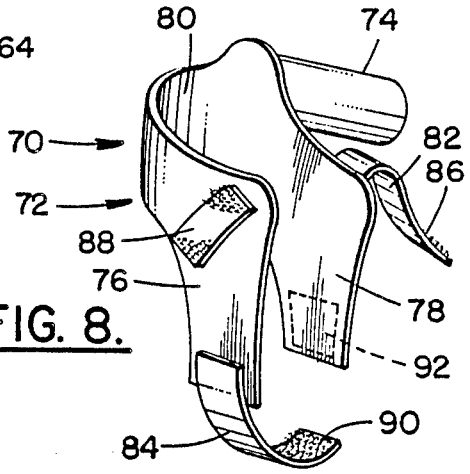
FIG. 8.

BOWLING AID

BACKGROUND OF THE INVENTION

I. Field of the Invention

The present invention relates generally to an aid for a person engaged in the sport of bowling and, particularly, to an aid which provides the bowler with an artificial thumb with which to support the ball and provide optimal control of the ball . during the approach and delivery phases of the sport.

II. Description of the Prior Art

Over the years, there have been numerous attempts to develop devices for the intended purpose of improving the skill of a bowler when plying his or her sport. Illustrative of such devices are disclosures of a number of Patents including U.S. Pat. Nos. No. 3,046,014 to Abruzzi, No. 3,208,749 to Skuse, and 3,214,167 to Pell.

Abruzzi discloses a wrist band which terminates at a prong which, in turn, is slightably receivable in a radially directed socket specially formed in the ball. With the fingers of the bowler received in either conventional holes or in slotted holes formed in the ball, it is thrown in a conventional manner. The wrist band serves to transfer most of the weight of the ball to the wrist and upon release of the ball, the prong is extracted from the socket with which it was inserted. It is said to be particularly useful with persons having relatively weak fingers such as children, the aged, and invalids who desire to bowl but who cannot properly hold and grip the heavy bowling bowl with only their fingers, as compared to a person having relatively strong fingers.

Skuse discloses a bowling aid which is strapped to the bowler's wrist and extends to one of the fingers to which it is attached at a distant location by means of a suitable opening. The aid extends between the palm of the bowler's hand and the ball and, in its underside, has a plurality of pins which project outwardly and are slidably received in associated holes formed in the outer surface of the bowling ball. As the ball is thrown, the pins automatically impart both "lift" or top spin to the ball without requiring the bowler to twist his or her wrist. As a result, strain and irritation to the wrist and arm muscles of a bowler are said to be avoided.

The Pell patent discloses a fingertip device which serves to maintain the normal leverage required to control a ball but which completely eliminates the need for insertion of the fingers into the ball. The ball has a conventional thumb hole but is modified to have a pair of spaced radial apertures which communicate with its outer surface. A curved plate is provided which generally conforms to the curvature of the ball and this plate has a pair of spaced projections at one extremity for reception into the apertures of the ball.

U.S. Pat. No.s 2,482,395 to Zander and 3,098,654 to Larsen disclose bowling aids which are specifically intended for handicapped people. The Zander patent is intended for use by a bowler who does not have a natural hand and that of Larsen is said to be especially useful by persons having stub fingers or with missing fingers or with any type of hand trouble.

U.S. Pat. No. 1,498,029 to Giles discloses a construction for attaching an artificial finger to a hand lacking other fingers but already having a thumb. The artificial finger thereby enables articles to be picked up when the natural thumb is pressed against the artificial finger. However, there is no mention of, or suggestion that, the construction be utilized in association with a bowling ball.

Yet another Patent, namely, U.S. Pat. No. 3,871,029 to Hollman discloses a bowling glove which extends from the wrist of the bowler to the base of the fingers and provides an opening for receiving the thumb. The glove is intended to restrict movement between the hand and the wrist and maintain the wrist straight at all times.

SUMMARY OF THE INVENTION

It was with knowledge of the prior art and difficulties which continue to exist for bowlers which gave rise to the present invention. The invention is directed toward a bowling aid to enable a person to bowl whose natural thumb is missing, deformed, or injured, or to provide a person having a healthy thumb with an alternative mode of ball handling and control. For such a purpose, a semi-rigid support member is removably received on the hand of the bowler and, when so received, extends between the upper surface of the hand and the palm of the hand and is contoured to snugly conform to the hand. An artificial thumb member is provided on the support member proximate to the general location of a natural thumb and projects away from the support member and away from the palm of the bowler's hand and is so sized and positioned as to be receivable in the thumb hole of a bowling ball when fingers of the bowler are received in the finger holes of the bowling ball. The bowling aid may be size adjustable and can be releasably secured to the hand. The support member may have an outer covering of flexible material, such as fabric, leather, or plastic nonwoven sheet material.

The bowling aid of the invention is intended to serve both experienced bowlers as well as novices to achieve more consistent ball control and resulting in greater accuracy and therefore improved scoring capability. It also provides an opportunity to those people who have not previously had the ability to bowl by reason of a defect in their thumb, whether congenital or caused by accident or disease. Another group of people who would benefit from the invention are those bowlers who bowl so frequently that their thumbs become excessively inflamed or even blistered from the continuous use.

The bowling aid of the invention is of a simplified construction, having a minimal number of parts. It is also inexpensive to manufacture, and composed of readily available materials. It can be made in a variety of sizes, but in any one size is also adjustable to fit a broad range of users.

The bowling aid of the invention is small and compact and can be used with an existing ball. In the alternative, the thumb hole of a bowling ball can be professionally re-drilled to receive the artificial thumb, should that be desired.

Other and further features, objects, advantages, and benefits of the invention will become apparent from the following description taken in conjunction with the following drawings. It is to be understood that both the foregoing general description and the following detailed description are exemplary and explanatory but are not restrictive of the invention. The accompanying drawings, which are incorporated in and constitute a part of this invention, illustrate some of the embodiments of the invention and, together with the description, serve to explain the principles of the invention in general terms.

BRIEF DESCRIPTION OF THE DRAWINGS

FIG. 4 is a perspective view of the bowling aid being applied to the hand of the bowler, illustrating the top surface of the hand, with certain parts being shown both in phantom and in solid lines in order to portray the attachment sequence of the bowling aid to the hand;

FIG. 5 is a perspective view of the bowling aid free of the bowler's hand but ready to be attached to the hand;

FIG. 7 is a cross section view taken generally along line 7—7 in FIG. 6;

FIG. 8 is a perspective view, similar to FIG. 5, of another embodiment of the invention.

DETAILED DESCRIPTION OF THE PREFERRED EMBODIMENTS

Figure 1:
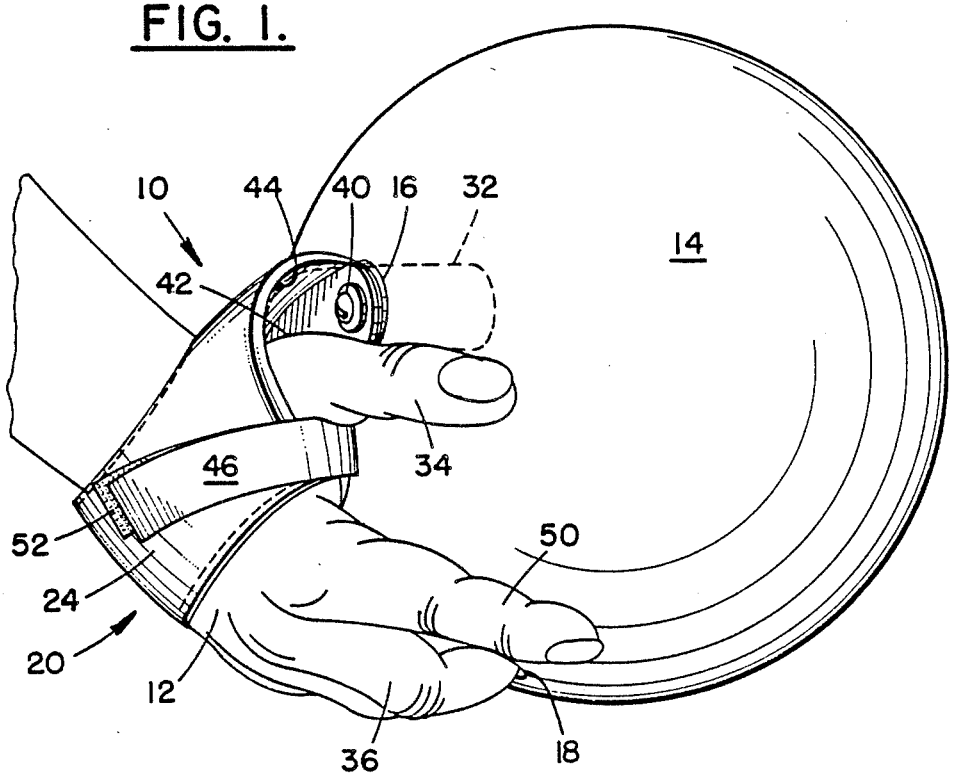
FIG. 1 is a perspective view illustrating the bowling aid of the invention on the hand of a bowler holding a bowling ball ready for use.

Turn now to the drawings, and initially to FIG. 1 which illustrates a bowling aid 10 embodying the invention ready for use. As such, it is firmly received on a hand 12 of the bowler, as the bowler is gripping a bowling ball 14. In a customary fashion, the bowling ball 14 is provided with a thumb receiving hole 16 and with finger receiving holes 18.

Figure 2:
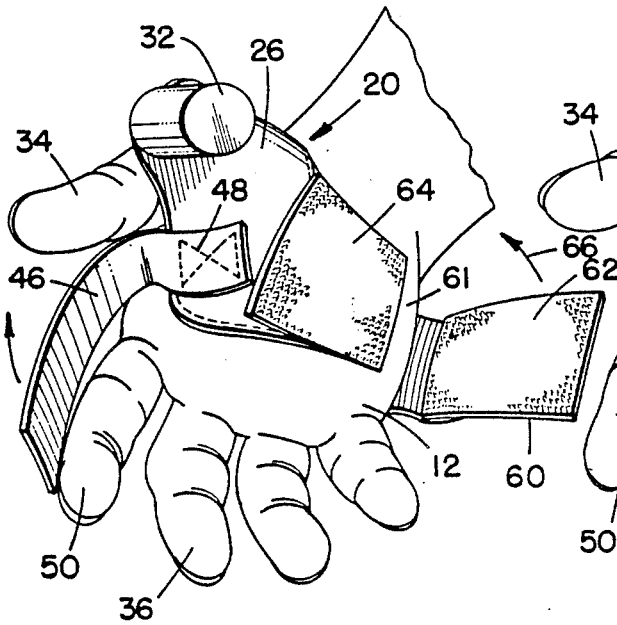
FIG. 2 is a perspective view of the bowling aid as it is being attached to the hand of the bowler, with the palm of the bowler's hand facing outwardly.
Figure 3:
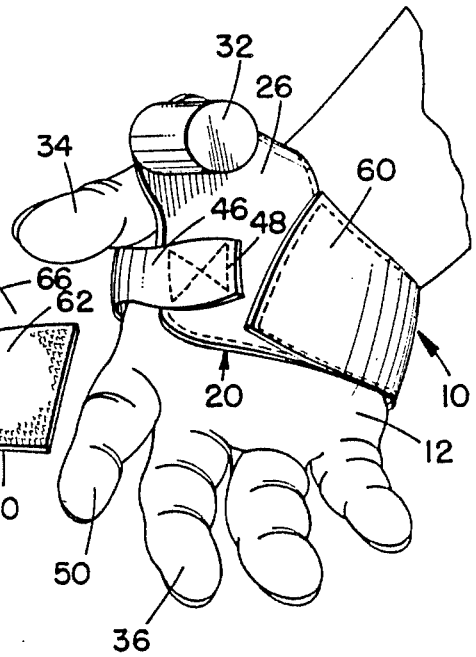
FIG. 3 is a view similar to FIG. 2 with the bowling aid securely attached to the bowler's hand.
Figure 6:
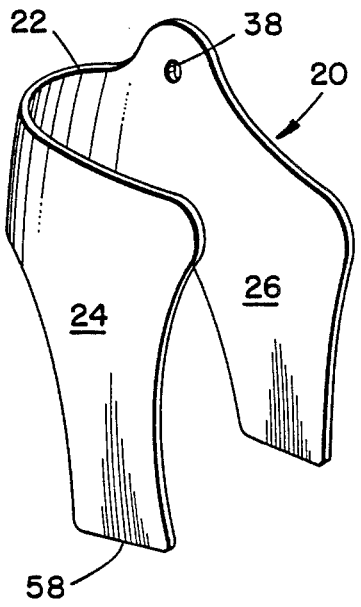
FIG. 6 is a perspective view of an uncovered support member, which is one component of the bowling aid.

The bowling aid 10 is illustrated in a number of different orientations received on the bowler's hand 12 in FIGS. 2–4 and is illustrated by itself in a hand receiving condition in FIG. 5. It includes a support member 20 (see FIG. 6) which is composed of semi-rigid sheet material which may be tough plastic, aluminum, or steel, for example. In any event, the material of which the support member 20 is composed must be sufficiently malleable to enable it to be bent to a form as illustrated in FIG. 6 and, further, to be able to conform closely to the shape of the bowler's hand when received thereon.

The support member 20 has an integral bridge portion 22 joining an upper element 24 and a lower element 26. The support member 20 is preferably provided with an outer covering 28 (FIG. 7) of flexible sheet material contiguously received thereon for improved comfort of the bowler and to improve the attractiveness of the bowling aid. The outer covering 28 may be, for example, fabric, leather, or nonwoven plastic material. It may be stitched onto the support member 20 as indicated by a seam 30, heat sealed, applied by means of adhesive, or held in place in any other suitable fashion. For purposes of explanation, it will be understood that the reference numerals 20, 22,.24, and 26 will be used in reference to the support member whether or not it is provided with an outer covering 28.

The bowling aid 10 also includes an artificial thumb member 32, generally cylindrically shaped, proximate to the general location of a natural thumb 34 when the support member is received on the hand 12 of the bowler. The artificial thumb projects away from the support member 20 and, specifically, away from the lower element 26 which generally conforms to the palm of the bowler's hand. The artificial thumb member 32 is so sized and positioned as to be receivable in the thumb hole of the bowling ball 14 when natural fingers 36 of the bowler are received in the finger holes 18 of the bowling ball. A hole 38 is suitably formed in the lower element 26 (FIG. 6) to receive a fastener 40 (FIGS. 1 and 5) threadedly engageable with a drilled and tapped hole formed in the artificial thumb member 32. The fastener 40 is tightened down until an end of the artificial thumb member 32 bears snugly against the lower element 26.

While it was previously mentioned that the artificial thumb member may be cylindrical, it may be slightly conical and its extreme outer end somewhat rounded to improve its ease of reception into and subsequent withdrawal from the thumb receiving hole 16 in the bowling ball 14. Also, it will be understood that although the artificial thumb member 32 may be positioned for reception into a thumb receiving hole 16 placed therein for the bowler's natural thumb, it may be desirable to redrill the bowling ball 14 so as to have a thumb receiving hole 16 positioned especially to receive the artificial thumb member 32 at a location particularly desirable for the bowler.

When the support member 20 is positioned on the hand as illustrated in FIGS. 1–4, the bridge portion 22 is seen to join the upper element 24 to the lower element 26 at a location proximate thenar eminence 42 at the base of the bowler's thumb 34 and defines a natural thumb receiving opening 44 proximate the bridge portion 22 and between the upper and lower elements 24, 26. An elongated web 46 of flexible material which, like the outer covering 28 may be composed, for example, of fabric, leather, or nonwoven plastic material, extends between the upper element 24 and lower element 26 in a region adjacent the natural thumb (FIGS. 1–4).

As particularly well seen in FIGS. 2 and 3, one end of the web 46 is fixed to the lower element 26. It may, for example, be attached as by stitching 48 to the outer covering 28 overlying the lower element 26. As seen in FIGS. 1–4, the web 46 is drawn across the crotch of the bowler's hand between the natural thumb 24 and the index finger 50 and thereby completes definition of the natural thumb receiving opening provided by the bowling aid 10.

Mutually engageable closure members 52, 54 are provided respectively on the upper element 24 and on a distant end of the web 46. The closure members 52, 54 may be mutually engageable hook and loop fastener material suitably attached to the outer covering 28 and to the web 46 and may be of the type commonly sold under the trademark "VELCRO". Of course, other forms of closure members may be employed such as buckles, snaps, or the like. However, closure members of the hook and loop variety are preferred because of the infinite range of adjustments which it provides. As the free end of the elongated web 46 is drawn in a direction away from the lower element 26 adjacent to the crotch between the natural thumb 35 and the index finger 50, it is desirable to press the upper and lower elements 24, 26 into firm engagement with the palm and upper surface of the hand 12, respectively, then cause engagement of the closure members 52, 54. In this manner, the bowling aid 10 is custom fitted to the hand of the bowler.

As seen in FIG. 5, while the outer covering 28 is contiguously formed over the semi-rigid sheet material of which the support member 20 is composed, another elongated web 56 which is integral with the outer covering 58 extends beyond a terminal edge 58 (FIG. 6) of the underlying support member 20. Also, as seen particularly well in FIGS. 2 and 3, the elongated web 56 has a free end 60 which is distant from the terminal edge 58 (FIG. 6) which can be drawn across the hypothenar prominence 61 (FIG. 2) of the bowler's hand.

As in the instance of the elongated web 46, the elongated web 56 has a closure member 62 thereon which is matingly engageable with a closure member 64 on the lower element 66. Similar to the instance of the web 46, the closure members 62, 64 may be mutually engageable hook and loop fastener material such as that commonly available under the trademark "VELCRO". If such is the case, the VELCRO material may be suitably attached to the outer covering 28 as by stitching, or the like. Also, similar to the instance of the web 46, the closure members 62, 64 may alternatively be in the form of buckles, clasps, or snaps, although VELCRO material is preferred because of its ability to provide closure over an infinite range of positions.

As the free end 60 is drawn in the direction of an arrow 66 (FIG. 2) to enable engagement of the closure members 62, 64, the upper element 24 is pressed into engagement with the upper surface of the hand and the lower element 26 is pressed into engagement with the palm of the hand with the web 56 drawn tightly over the hypothenar prominence. In this manner, as the closure members 62, 64 are engaged, the bowling aid 10 is firmly and snugly received on the bowler's hand and ready for use.

When the bowler is finished with using the aid 10, it is only necessary to release the closure members 62, 64 in the customary fashion, allowing the hand to be withdrawn from the aid. It would not normally be necessary to release the closure members 52, 54 associated with web 46 unless the bowling aid were to be used by a different person having a different sized hand.

Turn now to FIG. 8 which illustrates a different embodiment of the invention. A modified bowling aid 70 is depicted which is of molded one piece construction. Specifically, it may be desirable to provide a bowling aid 70 for which a support member 72 is integrally formed with an artificial thumb member 74. Similar in construction to the support member 20, the support member 72 includes an upper element 76, a lower element 78, and a bridge portion 80 connecting the upper and lower elements. In the embodiment of FIG. 8, however, there is no outer covering 28. Instead, elongated webs 82 and 84 are bonded or otherwise suitably affixed to the lower element 78 and upper element 76, respectively. Mutually engageable closure members 86, 88 are suitably provided on the web 82 and on an outer surface of the upper element 76. Similarly, mutually engageable closure members 90 and 92 are provided, respectively, at a free end of the elongated web 84 and on an outer surface of the lower element 78. All of the components of the modified bowling aid 70 operate in substantially the same manner as those of the earlier described bowling aid 10.

Figure 9:
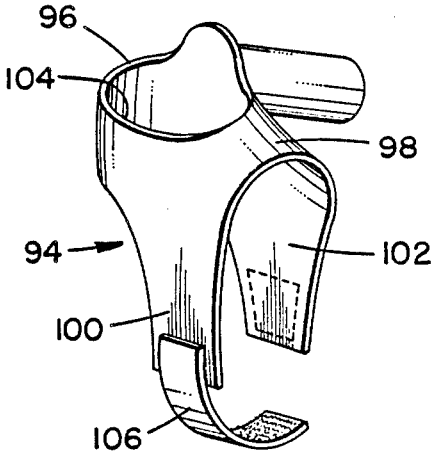
FIG. 9 is a perspective view, similar to FIGS. 5 and 8, of still another embodiment of the invention.

Another modified form of the invention is depicted in FIG. 9 and generally indicated by reference numeral 94. The bowling aid 94 differs from the aid 70 in that it has a pair of spaced bridge portions 96, 98 which are integral with upper and lower elements 100, 102 and fixedly define a natural thumb receiving opening 104. In this instance, the only size adjustment would be provided by an elongated web 106, but would result in a sturdier construction and would not require periodic fastening and unfastening of the web 82 as required in the instance of the aid 70.

While the preferred embodiments of the invention have been disclosed in detail, it should be understood by those skilled in the art that various modifications may be made to the illustrated embodiments without departing from the scope thereof as described in the specification and defined in the appended claims.

What I claim is:

1. An aid for a bowler, that is, a person engaged in the sport of bowling, said aid comprising:

a substantially rigid support member including an upper plate element and an integral lower plate element adapted to be removably received on the hand of the bowler and, when so received, extending continuously from the upper surface of the hand to the palm of the hand and contoured to snugly conform thereto, said upper plate element contiguously overlying the upper surface of the hand, said lower plate element contiguously underlying the palm of the hand; and an artificial thumb member rigidly mounted on said lower plate element proximate to the general location of a natural thumb when said support member is so received on the hand of the bowler to thereby prevent relative movement between said artificial thumb member and said lower plate element, said artificial thumb projecting away from said lower plate element and away from the palm of the bowler's hand and so sized and positioned as to be receivable in the thumb hole of a bowling ball when fingers of the bowler are received in the finger holes of the bowling ball;

thereby enabling the bowler to fully manipulate the ball without using a natural thumb.

2. A bowling aid as set forth in claim 1 wherein said support member is composed of sheet material.

3. A bowling aid as set forth in claim 2 including:

an outer covering of flexible sheet material contiguously received on said support member and composed of any one of fabric, leather, or non-woven plastic material.

4. A bowling aid as set forth in claim 1 wherein said support member has an integral bridge portion joining said upper plate element and said lower plate element at a location proximate to the thenar eminence at the base of the bowler's hand and defines a natural thumb receiving opening proximate to said bridge portion and between said upper plate element and said lower plate element.

5. A bowling aid as set forth in claim 4 wherein said support member has a second integral bridge portion joining said upper plate element and said lower plate element, spaced from said bridge portion, and which, together with said bridge portion and said upper and lower plate elements defines the natural thumb receiving opening.

6. A bowling aid as set forth in claim 4 including:

first releasable securing means including:

a first elongated web of flexible material fixed at one end to said lower plate element and having a distant end spaced from said fixed end, said first web extending to said upper plate element proximate to and across the crotch of the bowler's hand between the natural thumb and the index finger to complete definition of the natural thumb receiving opening; and mutually engageable closure means on said upper plate element and on said distant end of said first web enabling said upper plate element in the region of the crotch of the bowler's hand to be drawn toward said lower plate element to a selected configuration of said support member snugly conforming to the bowler's hand in the general region of the natural thumb, whereupon aid closure means are engaged to retain the selected configuration.

7. A bowling aid as set forth in claim 1 wherein said support member is of one piece construction including said upper plate element contiguous with the upper surface of the hand, said lower plate element contiguous with the palm of the hand, and a bridge portion joining said upper and lower plate elements proximate the thenar eminence at the base of the thumb, said support member being composed of material bendable in directions substantially transverse of the planes, respectively, of said upper plate element and said lower plate element and movable thereby between an enlarged configuration whereat said upper plate element is withdrawn from the upper surface of the hand and said lower plate element is withdawn from the palm of the hand and a reduced configuration whereat said upper plate element is contiguous with the upper surface of the hand and said lower plate element is contiguous with the palm of the hand; and including:

first releasable securing means for firmly retaining said support member in a selected configuration so as to snugly conform to the bowler's hand in the region of the natural thumb.

8. A bowling aid as set forth in claim 1 wherein said artificial thumb member is elongated and has a longitudinal axis; and including:

means for fixedly mounting said artificial thumb member to said lower plate element such that said longitudinal axis is transverse to said lower plate element.

9. A bowling aid as set forth in claim 1 wherein said artificial thumb member is elongated and has a longitudinal axis; and including:

means for releasably fixedly mounting said artificial thumb member to said lower plate element such that said longitudinal axis is transverse to said lower plate element.

10. A bowling aid as set forth in claim 1 wherein said support member is of one piece construction of material bendable in directions substantially transverse of the planes, respectively, of said upper plate element and said lower plate element and movable thereby between an enlarged configuration whereat said upper plate element is withdrawn from the upper surface of the hand and said lower plate element is withdrawn from the palm of the hand and a reduced configuration whereat said upper plate element is contiguous with the upper surface of the hand and said lower plate element is contiguous with the palm of the hand; and including:

releasable securing means for firmly retaining said support member in a selected configuration so as to snugly conform to the bowler's hand in the region of the hypothenar eminence.

11. A bowling aid as set forth in claim 10 wherein said releasable securing means includes:

an elongated web of flexible material fixed at one end to said lower plate element and having a distant end spaced from said fixed end, said elongated web extending to said upper plate element proximate to and across the hypothenar prominence of the bowler's hand; and mutually engageable closure means on said upper plate element and on said distant end of said second web enabling said upper plate element in the region of the hypothenar eminence of the bowler's hand to be drawn toward said lower plate element to a selected configuration of said support member snugly conforming to the bowler's hand, whereupon said closure means are engaged to retain the selected configuration.

12. A bowling aid as set forth in claim 4 including:

wherein said support member is of one piece construction of material bendable in directions substantially transverse of the planes, respectively, of said upper plate element and said lower plate element and movable thereby between an enlarged configuration whereat said upper plate element is withdrawn from the upper surface of the hand and said lower plate element is withdrawn from the palm of the hand and a reduced configuration whereat said upper plate element is contiguous with the upper surface of the hand and said lower plate element is contiguous with the palm of the hand; and including:

first releasable securing means including a first elongated web of flexible material fixed at one end to said lower plate element and having a distance end spaced from said fixed end, said first web extending to said upper plate element proximate to and across the crotch of the bowler's hand between the natural thumb and the index finger to complete definition of the natural thumb receiving opening; and mutually engageable closure means on said upper plate element and on said distant end of said first web enabling said upper plate element in the region of the crotch of the bowler's hand to be drawn toward said lower plate element to a selected configuration of said support member snugly conforming to the bowler's hand in the general region of the natural thumb, whereupon said closure means are engaged to retain the selected configuration; and including:

second releasable securing means including:

a second elongated web of flexible material fixed at one end to said lower plate element and having a distant end spaced from said fixed end, said second web extending to said upper plate element proximate to and across the hypotenar prominence of the bowler's hand; and mutually engageable closure means on said upper plate element and on said distant end of said second web enabling said upper plate element in the region of the hypothenar eminence of the bowler's hand to be draWn toward said lower plate element to a selected configuration of said support member snugly conforming to the bowler's hand, whereupon said closure means are engaged to retain the selected configuration.

13. A bowling aid as set forth in claim 12 wherein said closure means includes mutually engageable hook and loop fastener material.

* * * * *